US009402484B2

(12) United States Patent
Moore

(10) Patent No.: US 9,402,484 B2
(45) Date of Patent: Aug. 2, 2016

(54) SEAT COVER SYSTEM

(75) Inventor: Adrienne Moore, Aventura, FL (US)

(73) Assignee: Kehei Traveler Corporation, Aventura, FL (US)

( * ) Notice: Subject to any disclaimer, the term of this patent is extended or adjusted under 35 U.S.C. 154(b) by 101 days.

(21) Appl. No.: 12/603,375

(22) Filed: Oct. 21, 2009

(65) Prior Publication Data

US 2010/0140994 A1 Jun. 10, 2010

Related U.S. Application Data

(60) Provisional application No. 61/107,099, filed on Oct. 21, 2008.

(51) Int. Cl.
*A47C 31/00* (2006.01)
*A47C 31/11* (2006.01)

(52) U.S. Cl.
CPC ..... *A47C 31/11* (2013.01)

(58) Field of Classification Search
CPC ..... B60N 2/60; B60N 2/6036; B60N 2/6018; A47C 31/11
USPC ..... 297/219.1, 225, 227, 228.1, 228.12, 297/229, 135–174 CS, 219.11, 219.12, 228, 297/228.13
See application file for complete search history.

(56) References Cited

U.S. PATENT DOCUMENTS 1,303,021 A * 5/1919 Brock ..... 297/229
1,836,302 A * 12/1931 Bloomfield ..... 297/229
2,202,065 A * 5/1940 Peebles ..... 297/229
2,228,948 A * 1/1941 Field ..... 297/229
2,469,520 A * 5/1949 Roberts, Jr. ..... 297/225
3,729,037 A * 4/1973 Dare et al. ..... 150/158
3,858,256 A * 1/1975 Beer ..... 5/496
4,627,363 A * 12/1986 Jones ..... 108/90
4,705,084 A * 11/1987 Rodebaugh et al. ..... 108/90
5,392,543 A * 2/1995 Lehrman ..... 38/140
5,441,789 A * 8/1995 Walker ..... 428/78
5,605,374 A * 2/1997 Perry ..... 297/227
5,957,528 A * 9/1999 Campbell ..... 297/228.12
6,014,935 A * 1/2000 Willett ..... 108/90
6,135,635 A * 10/2000 Miller et al. ..... 383/2
6,155,637 A * 12/2000 Waters ..... 297/225
6,309,017 B1 * 10/2001 Middleton ..... 297/219.1
6,312,051 B1 * 11/2001 Adams ..... 297/228.11
6,491,996 B2 * 12/2002 Digangi ..... 428/43

(Continued)

FOREIGN PATENT DOCUMENTS

GB 2032268 A * 5/1980 ..... A47C 31/10

*Primary Examiner* — Laurie K Cranmer
(74) *Attorney, Agent, or Firm* — Lerner, David, Littenberg, Krumholz & Mentlik, LLP

(57) ABSTRACT

A cover system for a seat having a base, a back, armrests and a tray is provided. The cover system includes a main cover with a bottom portion extending across the base of the seat and a top portion extending across and over the back of the seat. The cover system further includes first and second armrest covers defining an open end opposing a closed end. The first and second armrest covers extend over the armrests of the seat with the closed ends thereof abutting outwardly facing ends of the armrests. The cover system also includes tray cover adapted to extend over the tray of the seat. The tray cover has at least first and second securing components extending from opposite sides thereof. The first and second securing members secure the tray cover relative to the tray of the seat.

14 Claims, 6 Drawing Sheets

(56) References Cited

U.S. PATENT DOCUMENTS

| | | | | |
|---|---|---|---|---|
| 6,578,914 | B2 * | 6/2003 | Artsvelyan | 297/219.1 |
| 6,616,225 | B2 * | 9/2003 | Graff | 297/229 |
| 6,626,491 | B1 * | 9/2003 | Blome et al. | 297/229 |
| 6,631,950 | B1 * | 10/2003 | Madole | 297/228.11 |
| 6,648,410 | B2 * | 11/2003 | Sparks | 297/228.12 |
| 6,655,737 | B2 * | 12/2003 | Hyduk | 297/229 |
| 6,783,175 | B1 * | 8/2004 | Henderson | 297/4 |
| 6,948,771 | B1 * | 9/2005 | Salandy | 297/228.11 |
| 7,066,535 | B2 * | 6/2006 | Moses | 297/229 |
| 7,287,813 | B2 * | 10/2007 | Aliev | 297/219.1 |
| 7,360,834 | B2 * | 4/2008 | Miller et al. | 297/225 |
| 7,431,396 | B1 * | 10/2008 | Dasso | 297/227 |
| 7,637,567 | B2 * | 12/2009 | Neustat et al. | 297/228 |
| 7,762,628 | B2 * | 7/2010 | Williams | 297/229 |
| 7,841,658 | B1 * | 11/2010 | Marble | 297/224 |
| 2002/0178975 | A1 * | 12/2002 | Lewis et al. | 108/90 |
| 2003/0042774 | A1 * | 3/2003 | Hackett | 297/227 |
| 2007/0069560 | A1 * | 3/2007 | Ranney | 297/219.1 |
| 2009/0223418 | A1 * | 9/2009 | Ferrara | 108/14 |

* cited by examiner

SEAT COVER SYSTEM

PRIORITY

This application claims priority to U.S. Provisional Patent Application No. 61/107,099, filed Oct. 21, 2008, the disclosure of which is expressly incorporated by reference into this application.

FIELD

The present disclosure relates to barrier and cover systems for seats, especially seats in public places used by a number of people.

BACKGROUND

Seating surfaces on mass transportation vehicles such as airplanes or trains or seating provided at public venues such as theaters or arenas are often infrequently cleaned and as a result are often dirty. Moreover, it is not often practical or possible for a user to clean their own seating area, much less transport and store the cleaning supplies and tools required to truly clean seating surfaces to such vehicles or venues. Accordingly, a cover system which provides a barrier between a user and a contaminated seating area, while being easy to transport and store, is desirable.

SUMMARY

The present disclosure provides seating area barrier system having a main cover with a generally rectangular shape. The main cover includes a bottom portion adapted to extend across a base of a seat and a top portion adapted to extend across and over a back portion of a seat. The main cover defines a underside adapted to directly contact a seat and a topside opposite the bottom side and adapted to contact a user. The seating area barrier system further includes first and second elongate securing members coupled to the main cover at opposing positions proximate a perimeter of the main cover. The first and second securing members selectively engage the top portion of the main cover and removably secure the main cover relative to a seat.

The present disclosure further provides a cover system for a seat having a base, a back, armrests and a tray. The cover system includes a main cover having a generally rectangular shape. The main cover includes a bottom portion adapted to extend across the base of the seat and a top portion adapted to extend across and over the back of the seat. The main cover further includes first and second elongate securing members extending from opposite sides thereof, the first and second securing members selectively engaging the top portion of the main cover. The first and second securing members are adapted to secure the main cover relative to the seat. The cover system further includes first and second armrest covers having a generally elongate shape with a U-shaped cross section. The first and second armrest covers each further include an open end opposing a closed end. The first and second armrest covers are adapted to extend over the armrests of the seat with the closed ends thereof abutting outwardly facing ends of the armrests. The cover system also includes a tray cover adapted to extend over the tray of the seat. The tray cover has a generally rectangular shape with at least first and second securing components extending from opposite sides thereof. The first and second securing members are adapted to secure the tray cover relative to the tray. The main cover, the first and second armrest covers, and the tray cover of the cover system are all made of relatively lightweight, material and are foldable to a relatively compact size for transportation and storage. The cover system may also include a carrier adapted to store the main cover, the first and second armrest covers, and the tray cover with the main cover, the first and second armrest covers, and the tray cover being folded on themselves.

DETAILED DESCRIPTION

Figure 1:
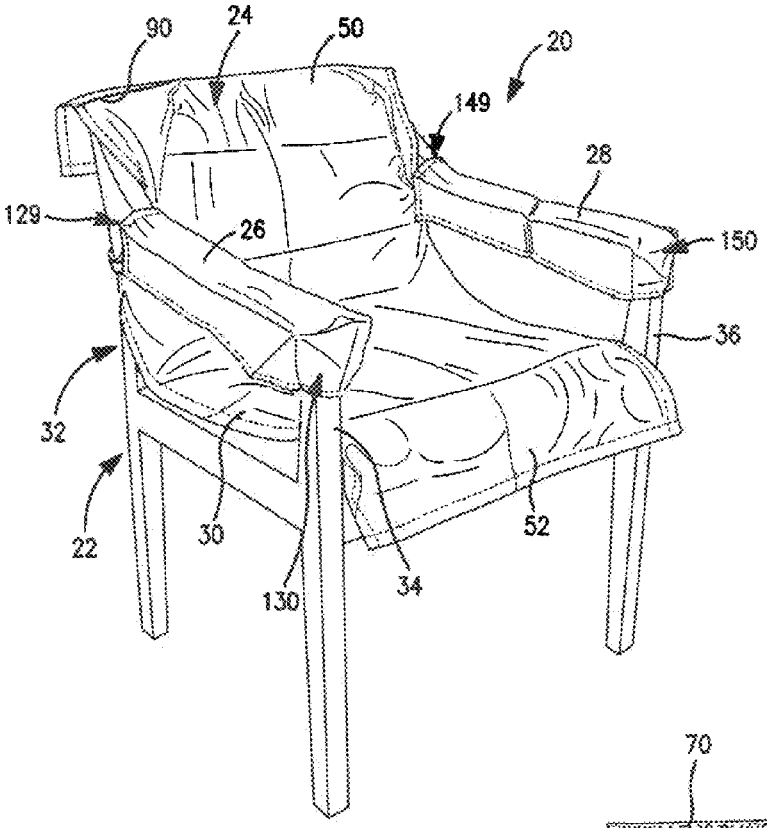
FIG. 1 is an illustration with a perspective view of a cover system for a seat with armrests according to the principles of the present disclosure.

Referring to FIG. 1, an exemplary cover system 20 according to the principles of the present disclosure is shown covering a conventional armchair 22. Cover system 20 includes a main cover 24 and first and second armrest covers 26, 28. By covering the base 30, back 32, and armrests 34, 36 of armchair 22, cover system 20 provides a barrier between armchair 22 and a user thereof.

It should be understood that a cover system according to the principles of the present disclosure can be used with a variety of chairs, seats, seating areas, and other resting places; namely chairs and seats in public places. As such, while the present disclosure includes details of exemplary cover system 20 relative to armchair 22, it should be understood that the present disclosure is not limited this particular exemplary embodiment. In particular, by way of non-limiting example, a cover according to the principles of the present disclosure may be used with airplane and train seating areas, including trays as described in more detail herein, as well as with theater, arena, and stadium seats.

With further reference to FIGS. 2-11, main cover 24 of cover system 20 is shown in further detail. Main cover 24 includes a top portion 50 configured to extend across and over back 32 of armchair 22 and a bottom portion 52 configured to extend across base 30 of armchair 22. Main cover 24 further includes first and second securing members 54, 56 extending from opposite sides thereof. Exemplary first and second securing members 54, 56 are in the form of elongate straps having the same size and shape.

Figure 3:
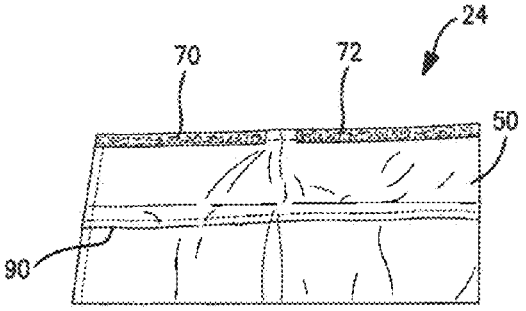
FIG. 3 is an illustration with an overhead view of the top portion of the main cover of FIG. 2.
Figure 2:
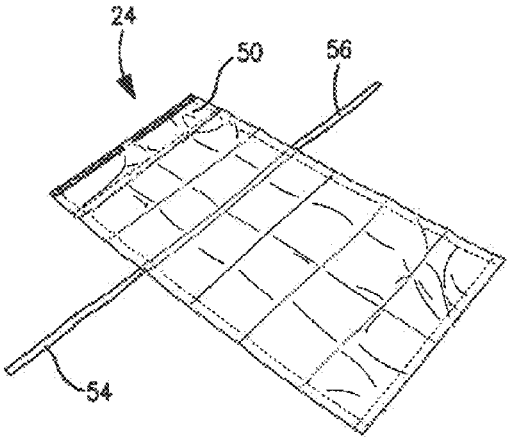
FIG. 2 is an illustration with an overhead view of the front side of a main cover component of a cover system according to the principles of the present disclosure.
Figure 4:
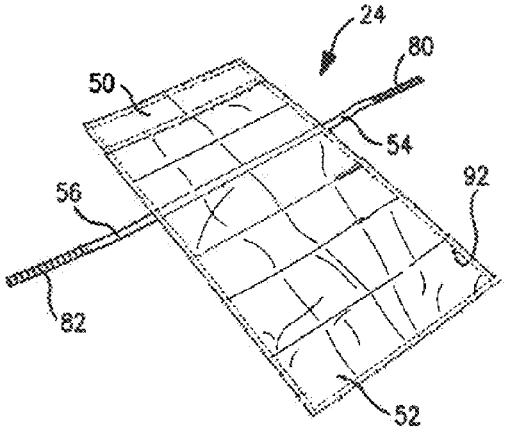
FIG. 4 is an illustration with an overhead view of the underside of the main cover of FIG. 2.

With particular reference to FIGS. 3-4, top portion 50 includes first and second segments 70, 72 of a first coupling material disposed along the edge thereof. First and second securing members 54, 56 including first and second segments 80, 82 of a second coupling material, respectively. The first and second coupling materials are complementary to each other so as to removably secure to one another, when engaged. For example, the coupling material at segments 70, 72 is a loop material, and the coupling material at segments 80, 82 is a hook material which can removably engage the loop material.

Top portion 50 further includes a pleat 90 to guide main cover 24 over back 32 of armchair 22 and provide additional strength to main cover 24. Main cover 24 also includes an exterior hem 92 formed at the perimeter thereof, also to add strength and durability to main cover 24.

Figure 5:
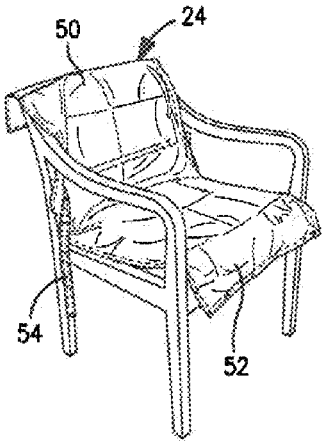
FIGS. 5 and 6 are illustrations with perspective views of a main cover component of a cover system disposed on a seat with the securing members and top portion disengaged according to the principles of the present disclosure.
Figure 6:
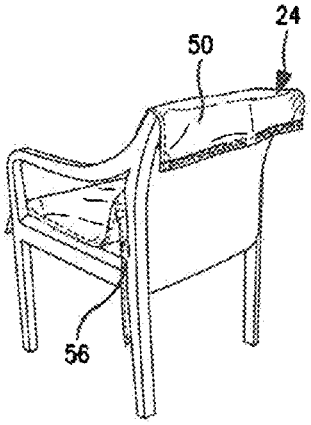
Figure 7:
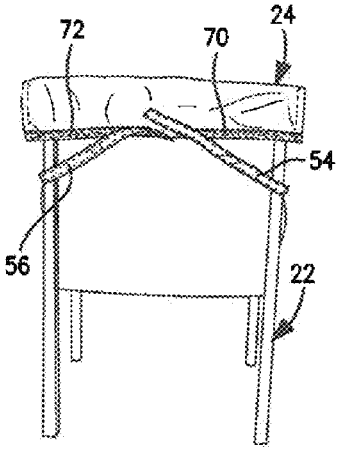
FIG. 7 is an illustration with a perspective view of the main cover of FIGS. 5 and 6 with the securing members and top part engaging and securing the main cover relative to the seat according to the principles of the present disclosure.
Figure 8:
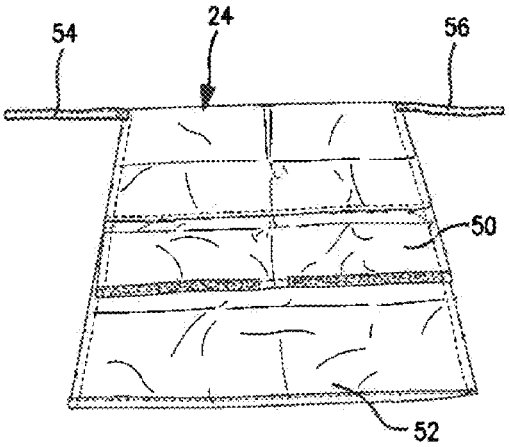
FIGS. 8-11 are illustrations with overhead views of a main cover component for a cover system being folded according to the principles of the present disclosure.
Figure 9:
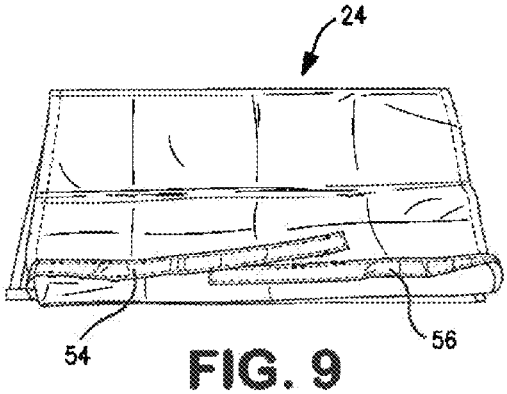
Figure 10:
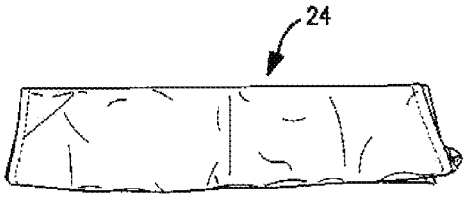
Figure 11:
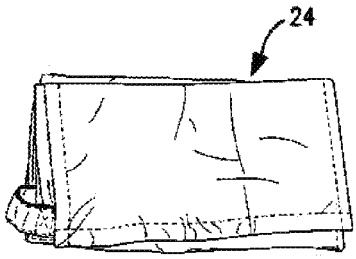

With particular reference to FIGS. 5-7, the installation of main cover 24 on armchair 22 is shown. Main cover 24 is disposed on armchair 22 with top portion 50 extending over back 32 and bottom portion 52 extending over seat 30. Next, first and second securing members 54, 56 are wrapped around back 32 of armchair 22 and engaged with top portion 50 so that the segments 70, 72 and the segments 80, 82 are engaged and, therefore, first and second securing members 54, 56 are secured relative to top portion 50. As first and second securing members are wrapped around back 32 of armchair 22, main cover 24 is secured relative to armchair 22.

Referring to FIGS. 8-11, main cover 24 is shown as successively folded over itself to a compact size. As such, when not in use, main cover 24 can be easily transported and stored.

Referring now to FIGS. 1 and 12-17, first and second armrest covers 26, 28 of cover system 20 are shown in detail. It should be understood that first and second armrest covers 26, 28 are substantially similar or the same, and that a description of one of first and second armrest covers 26, 28 applies equally to the other, unless otherwise noted. Therefore, several details of first and second armrest covers 26, 28 are only described herein with reference to first armrest cover 26.

Figure 12:
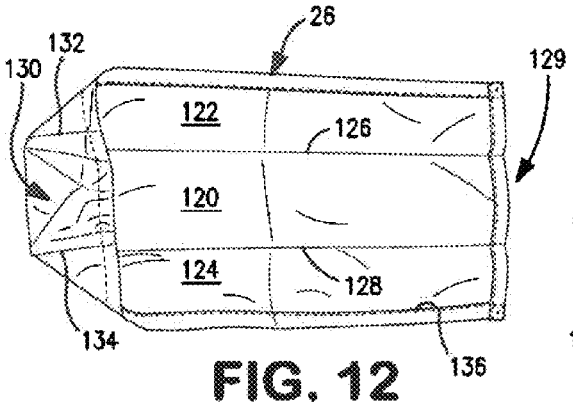
FIG. 12 is an illustration with an overhead view of the underside of an armrest cover component for a cover system according to the principles of the present disclosure.
Figure 13:
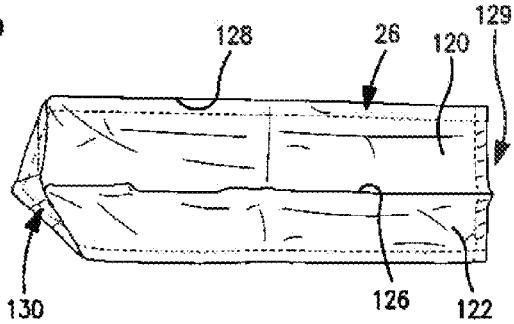
FIG. 13 is an illustration with an overhead view of the topside of the armrest cover of FIG. 12.

With particular reference to FIGS. 12-13, first armrest cover 26 includes three elongate sections: a center section 120, a first side section 122, and a second side section 124. Center and first side sections 120, 122 are separated by a pleat 126, and center and second side sections 120, 124 are separated by a pleat 128.

First armrest cover 26 defines an open end 129 and a closed end 130. To form closed end 130, center section 120 extends further than side sections 122, 124 at closed end 130, bends generally perpendicularly, and is secured to edges 132 and 134 of first and second side sections 122, 124, respectively. Edges 132 and 134 are generally perpendicular to pleats 126, 128, respectively. First armrest cover 26 further includes an exterior hem 136 at the perimeter thereof to provide durability and strength to first armrest cover 26.

Figure 14:
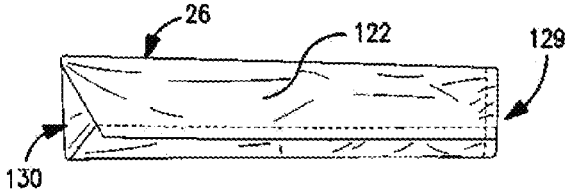
FIGS. 14-15 are illustrations with overhead views of the armrest cover of FIG. 12 being folded according to the principles of the present disclosure.
Figure 15:
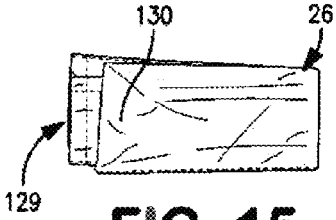
Figure 16:
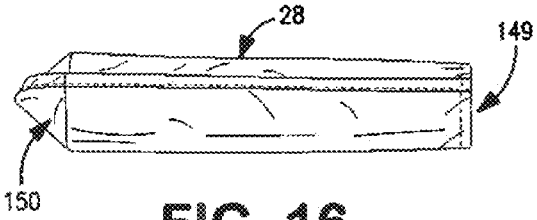
FIGS. 16-17 are illustrations with overhead views of another armrest cover being folded according to the principles of the present disclosure.
Figure 17:
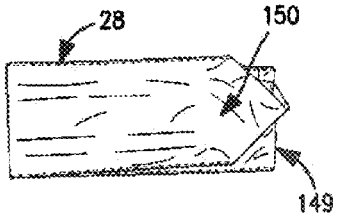

Referring to FIGS. 14-15, first armrest cover 26 is shown successively folded over itself to a compact size, with closed end 130 collapsing inwardly. Referring to FIGS. 16-17, second armrest cover 28, defining an open end 149 and a closed end 150 is shown successively folded over itself to a compact size, with closed end 150 collapsing outwardly. With reference to all of FIGS. 14-17, when not in use, first and second armrest covers 26, 28 can be easily transported and stored.

Figure 18:
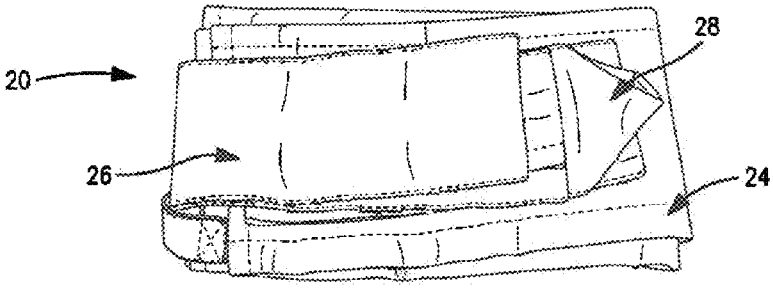
FIG. 18 is an illustration with an overhead view of a cover system having a main cover component and two armrest cover components which are folded for storage and/or transportation according to the principles of the present disclosure.
Figure 19:
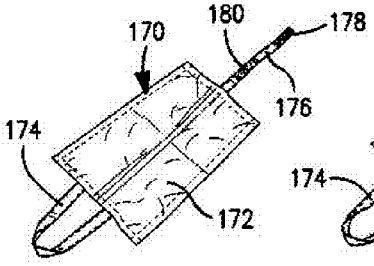
FIG. 19 is an illustration with a perspective view of the topside of a tray cover component of a cover system for a seat with a tray according to the principles of the present disclosure.
Figure 20:
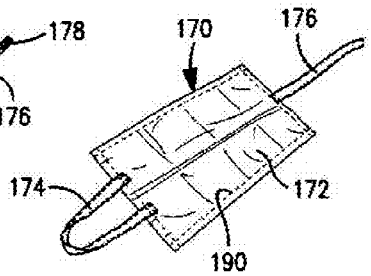
FIG. 20 is an illustration with a perspective view of the underside of the tray cover of FIG. 19.

With reference to FIG. 18, cover system 20 is shown with main cover 24 and first and second armrest covers 26, 28 all folded to a compact size. As such, when not in use, the entirety of cover system 20 can be easily transported and stored.

Cover system 20 may further include a tray cover. For example, seats in trains and airplanes typically include a fold out tray. A tray cover according to the principles of the present disclosure may be used to provide a barrier between a user of such a seat and the surface of the tray.

Figure 21:
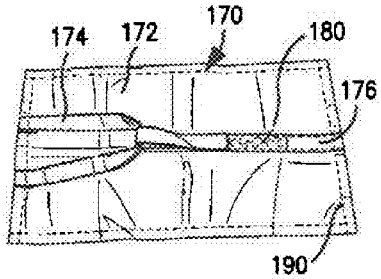
FIG. 21 is an illustration with an overhead view of the underside of the tray cover of FIG. 19 with the securing members being engaged according to the principles of the present disclosure.

Referring now to FIGS. 19-23, a tray cover 170 according to the principles of the present disclosure is shown. Tray cover 170 includes a main section 172 having a generally rectangular shape and first and second securing members 174, 176 extending from opposite sides of main section 172. As show in the figures, first securing member 174 may be in the form of a loop, while second securing member may be in the form of a strip having a first coupling material segment 178 and a second coupling material segment secured thereto. With particular reference to FIG. 21, second coupling member 176 may extend through the loop formed by first coupling member 174 and engage first and second coupling material segments 178, 180 together. First and second coupling material segments 178, 180 are made of complementary materials which removably secure when engaged, such as loop and hook material, respectively. When tray cover 170 is disposed on a tray, first and second securing members may extend underneath the tray and engage each other to secure tray cover 170 relative to the tray.

Figure 22:
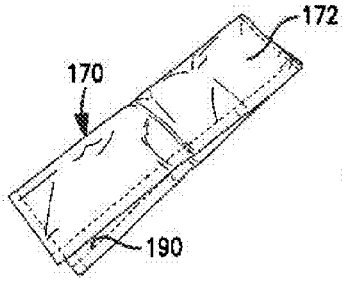
FIGS. 22-23 are illustrations with overhead views of the tray cover of FIG. 19 being folded according to the principles of the present disclosure.
Figure 23:
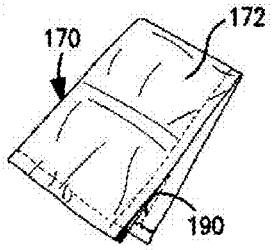

Referring to FIGS. 22-23, tray cover 170 is shown as successively folded over itself to a compact size. As such, when not in use, tray cover 170 can be easily transported and stored.

Figure 24:
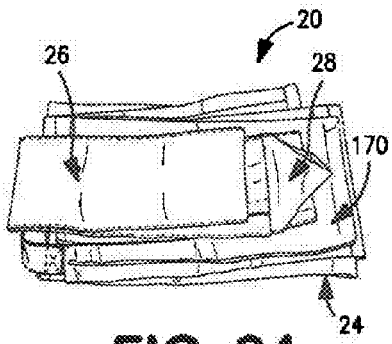
FIG. 24 is an illustration with an overhead view of a cover system having a main cover component, a tray cover component, and two armrest cover components which are folded for storage and/or transportation according to the principles of the present disclosure.
Figure 25:
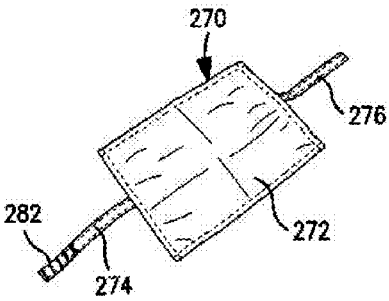
FIG. 25 is an illustration with a perspective view of the topside of another tray cover component of a cover system for a seat with a tray according to the principles of the present disclosure.
Figure 26:
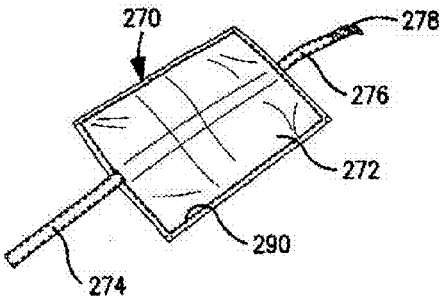
FIG. 26 is an illustration with a perspective view of the underside of the tray cover of FIG. 25.

Furthermore, with reference to FIG. 24, cover system 20 is shown with main cover 24, first and second armrest covers 26, 28 and tray cover 170 all folded to a compact size. As such, when not in use, the entirety of cover system 20 can be easily transported and stored.

Figure 27:
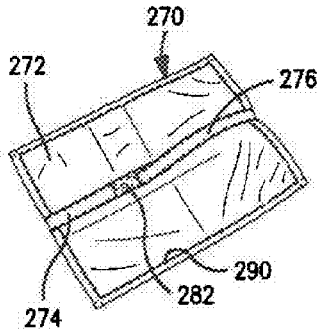
FIG. 27 is an illustration with an overhead view of the underside of the tray cover of FIG. 25 with the securing members being engaged according to the principles of the present disclosure.

Referring now to FIGS. 25-29, another tray cover 270 according to the principles of the present disclosure is shown. Tray cover 270 includes a main section 272 having a generally rectangular shape and first and second securing members 274, 276 extending from opposite sides of main section 272. As show in the figures, first and second securing members 274, 276 may be in the form of strips. Second securing member 276 has a first coupling material segment 278 secured thereto, and first securing member 274 has a second coupling material segment 282 secured thereto. With particular reference to FIG. 27, first and second coupling members 274, 276 may be folded over to engage first and second coupling material segments 278, 282 together. First and second coupling material segments 278, 282 are made of complementary materials which removably secure when engaged, such as loop and hook material, respectively. When tray cover 270 is disposed on a tray, first and second securing members 274, 276 may extend underneath the tray and engage each other to secure tray cover 270 relative to the tray.

Figure 28:
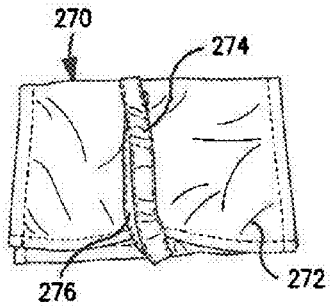
FIGS. 28-29 are illustrations with overhead views of the tray cover of FIG. 25 being folded according to the principles of the present disclosure.
Figure 29:
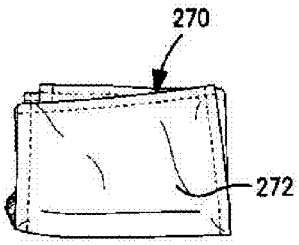

Referring to FIGS. 28-29, tray cover 270 is shown as successively folded over itself to a compact size. As such, when not in use, tray cover 270 can be easily transported and stored.

Figure 30:
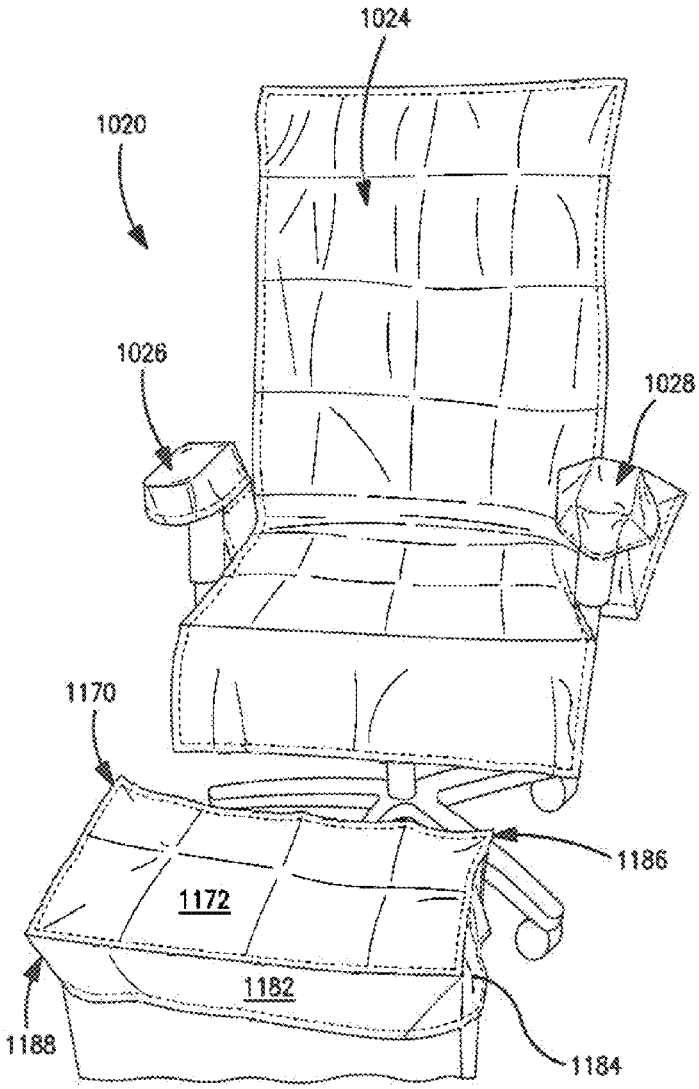
FIGS. 30-32 are illustrations of another cover system according to the principles of the present disclosure.
Figure 31:
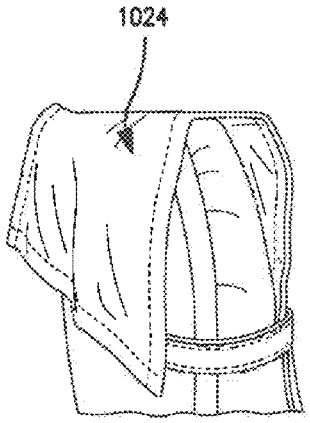
Figure 32:
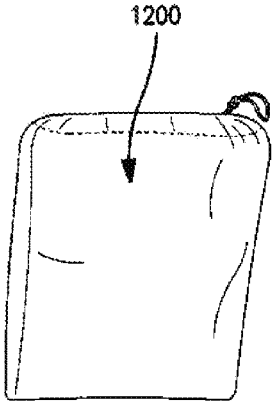
Figure 33:
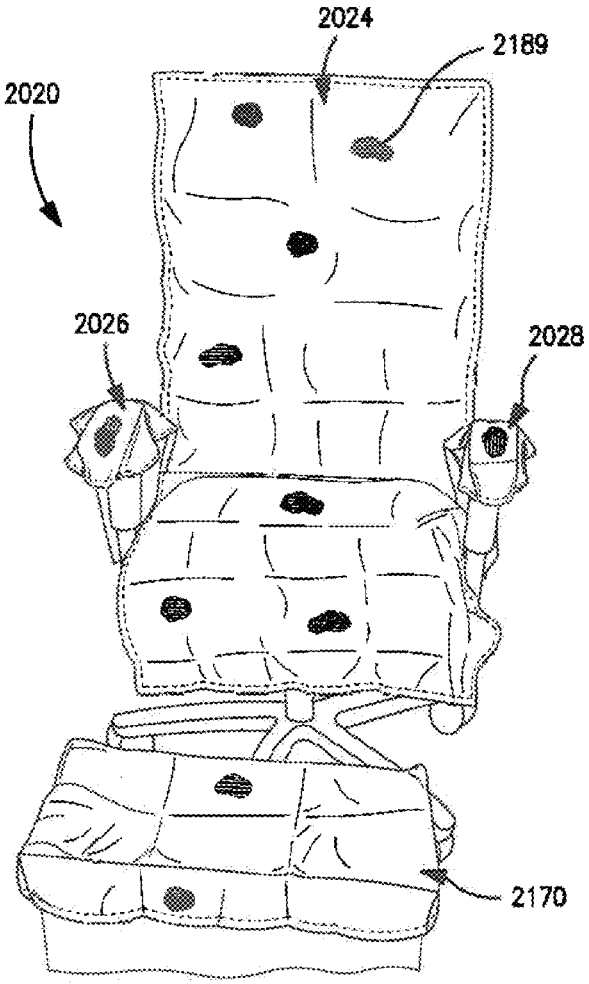
FIGS. 33-36 are illustrations of yet another cover system according the principles of the present disclosure.
Figure 34:
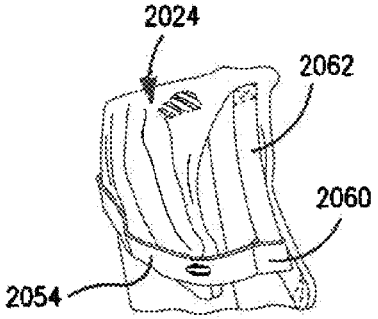
Figure 35:
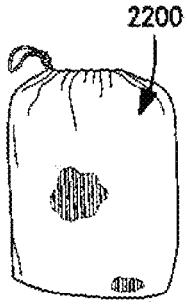

Another cover system 1020 according to the principles of the present disclosure is depicted in FIGS. 30-32. Main cover 1024 is disposed over the seat and back of an exemplary chair, first and second armrest covers 1026, 1028 are disposed over the armrests of the chair, and tray cover 1170 is disposed over a tray (explanatorily depicted in FIG. 30 by a box). Unless otherwise provided herein, it should be understood that the components of cover system 1020 are substantially similar or the same as the components of cover system 20 described herein.

With particular reference to FIG. 30, tray cover 1170 of cover system 1020 is formed with a main section 1172 configured to correspond with the top surface of the tray and sidewalls 1182, 1184, 1186 (not visible), 1188 (not visible) extending from main section 1172. As such, sidewalls 1182, 1184, 1186, 1188 of tray cover 1170 abut the edges and side portions of the tray to maintain the positioning of tray cover 1170 relative to the top surface of the tray.

Referring to FIG. 32, cover system 1020 also includes a carrier 1200. Carrier 1200 is configured to hold all of the components of cover system 1020 when they are folded to a compact size.

Referring now to FIGS. 33-36, yet another cover system 2020 according to the principles of the present disclosure is illustrated. Unless otherwise provided herein, it should be understood that the components of cover system 2020 are substantially similar or the same as the components of cover system 1020 described herein.

Main cover 2024 of cover system 2020 includes a first securing member 2054 with an end 2060 in the form of a closed loop movably disposed around a guide member 2062. Guide member 2062 is secured to the underside of main cover 2024 so as to define a closed path for end 2060 of first securing member 2054 to translate. With this configuration, cover system 2020 is adaptable to seating areas of varying size and varying positions of main cover 2024, as first securing member 2054 can be positioned to correspond with the coupling material and/or other fastening device.

Figure 36:
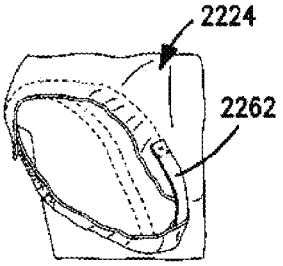

Referring in particular to FIG. 36, another configuration of cover system 2020 is disclosed. Main cover 2224 is substantially similar to main cover 2024, but guide member 2262 is positioned on the topside of main cover 2224.

Figure 37:
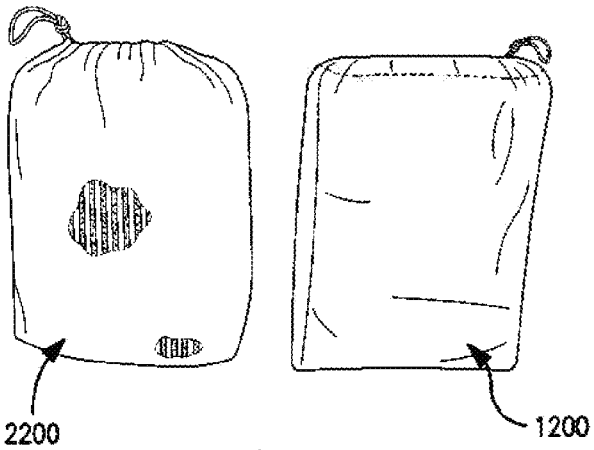
FIG. 37 is an illustration of the carrier components of the cover systems of FIGS. 30-32 and FIGS. 33-36.

With reference to FIG. 37, carrier 1200 of cover system 1020 and carrier 2200 of cover system 2020 are depicted. As is depicted in the illustrated pattern portions of cover system 2020, such as portion 2189 of FIG. 33, cover systems according to the principles of the present disclosure can be made from a variety of materials to appeal to a variety of tastes, while maintaining the same configuration and functionality.

According to the principles of the present disclosure, to further provide for the use, transportation, and storage of a cover system as disclosed herein, the main sections of components thereof are made of lightweight, flexible materials. Such materials can be the same or may vary between the components. The materials can be launderable, so as to be machine washable by a consumer. The materials can also be treated to have anti-microbial properties. Alternatively, the materials can be selected so that the overall system is disposable and biodegradable, such as durable paper.

The system of the present disclosure further vary. For example, a cover system according to the present disclosure can include more components, such as a carrying case. The components of a cover system according to the present disclosure can be made of a variety of materials, have a variety of shapes, and have a variety of configurations. For example, the securing members for the various components can have differing locations, and more than two securing members can be provided on any one component. Furthermore, the components of a cover system according to the present disclosure include a variety of materials, mechanisms, or devices for removably securing and engaging each other. For example, a main cover component according to the principles of the present disclosure could include snap or button assemblies in place of or in addition to the coupling materials on the top portion and the securing members. Additionally, according to the principles of the present disclosure, a main cover can be configured to be secured to a seat without securing members, such as having coupling material on the underside of the top portion thereof and engaging with complementary coupling material built into a seat.

Accordingly, it is to be understood that the present disclosure is merely exemplary in nature and that it is not limited to any particular embodiment or feature disclosed herein.

What is claimed is:

1. A seating area barrier system comprising:

a main cover having a generally rectangular shape, said main cover including a bottom portion adapted to extend across a base of a seat and a top portion adapted to extend across and over a back portion of a seat, said main cover defining a underside adapted to directly contact a seat and a topside opposite said bottom side and adapted to contact a user;

an elongate strap member coupled to said main cover at a position proximate a perimeter of said main cover, said elongate strap member selectively engaging said top portion of said main cover and removably securing said main cover relative to a seat; and an elongate guide member with opposing guide ends secured to said main cover;

wherein said elongate strap member includes a first closed loop end, said elongate strap member being coupled to said main cover with said closed loop end disposed around said elongate guide member between said guide ends.

2. The seating area barrier system of claim 1, wherein said guide member is attached to said underside of said main cover.

3. The seating area barrier system of claim 1, wherein said main cover includes a pleat extending across said top portion thereof, said pleat adapted to guide said top portion over a back portion of a seat.

4. The seating area barrier system of claim 1, wherein said main cover includes and exterior hem extending around said main cover proximate said perimeter of said main cover.

5. The seating area barrier system of claim 1, further comprising first and second armrest covers each having a generally elongate shape with a U-shaped cross section, said first and second armrest covers each further including an open end opposing a closed end, said first and second armrest covers being adapted to extend over armrests of a seat with said closed ends thereof abutting outwardly facing ends of armrests.

6. The seating area barrier system of claim 5, wherein said first and second armrest covers each include a pair of pleats extending parallel to each other between said open ends and said closed ends, said pleats spaced apart from each other so as to define top portions of said first and second armrest covers adapted to rest on tops of armrests and opposing side portions of said first and second armrest adapted to extend from armrests towards a base of a seat.

7. The seating area barrier system of claim 6, wherein said first and second armrest covers each include an exterior hem proximate perimeters of said first and second armrest covers.

8. The seating area barrier system of claim 1, further comprising a tray cover being adapted to extend over a tray of a seat, said tray cover having a generally rectangular shape with at least first and second securing components extending from opposite sides thereof, said first and second securing members being adapted to secure said tray cover relative to a tray.

9. The seating area barrier system of claim 8, wherein said at least first and second securing components removably engage each other.

10. The seating area barrier system of claim 9, wherein said first securing component is secured to said tray cover in a loop and said second securing component is an elongate member extending from said tray cover opposite said first securing component, said second securing component including complementary coupling portions, said second securing component selectively extending through said loop of said first securing component and removably engaging said complementary coupling portions to removably secure said first and second securing components together.

11. The seating area barrier system of claim 10, wherein said complementary coupling portions each include one of a hook material and a loop material.

12. The seating area barrier system of claim 9, wherein said first and second securing components are elongate members extending from said tray cover from opposing positions thereon, said first and second securing components including complementary coupling portions, said first and second securing components selectively engaging each other at said complementary coupling portions to removably secure said first and second securing components together.

13. The seating area barrier system of claim 12, wherein said complementary coupling portions each include one of a hook material and a loop material.

14. The seating area barrier system of claim 1, further comprising a carrier adapted to store said main cover with said main cover being folded on itself.

* * * * *